US011785409B1

(12) United States Patent
Mansour

(10) Patent No.: US 11,785,409 B1
(45) Date of Patent: Oct. 10, 2023

(54) MULTI-STAGE SOLVER FOR ACOUSTIC WAVE DECOMPOSITION

(71) Applicant: Amazon Technologies, Inc., Seattle, WA (US)

(72) Inventor: Mohamed Mansour, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 17/529,560

(22) Filed: Nov. 18, 2021

(51) Int. Cl.
*H04S 7/00* (2006.01)
*G10L 19/008* (2013.01)
*H04R 3/00* (2006.01)

(52) U.S. Cl.
CPC ..... *H04S 7/302* (2013.01); *G10L 19/008* (2013.01); *H04R 3/005* (2013.01)

(58) Field of Classification Search
CPC ..... H04R 3/005
USPC ..... 381/92, 303, 110; 700/94
See application file for complete search history.

(56) References Cited

U.S. PATENT DOCUMENTS 10,149,048 B1 * 12/2018 Stefanakis ..... H04R 3/005
2005/0046584 A1 * 3/2005 Breed ..... G01S 7/4802 340/13.31
2017/0278513 A1 * 9/2017 Li ..... G10L 15/20
2019/0293743 A1 * 9/2019 Reisenfeld ..... G01S 3/043

* cited by examiner

*Primary Examiner* — Alexander Krzystan
(74) *Attorney, Agent, or Firm* — PIERCE ATWOOD LLP

(57) ABSTRACT

Disclosed are techniques for an improved method for performing Acoustic Wave Decomposition (AWD) processing that reduces a complexity and processing consumption. The improved method enables a device to perform AWD processing to decompose an observed sound field into directional components, enabling the device to perform additional processing such as sound source separation, dereverberation, sound source localization, sound field reconstruction, and/or the like. The improved method splits the solution to two phases: a search phase that selects a subset of a device dictionary to reduce a complexity, and a decomposition phase that solves an optimization problem using the subset of the device dictionary.

20 Claims, 12 Drawing Sheets

MULTI-STAGE SOLVER FOR ACOUSTIC WAVE DECOMPOSITION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture audio and process audio data. The audio data may be used for voice commands and/or sent to a remote device as part of a communication session. To process voice commands from a particular user or to send audio data that only corresponds to the particular user, the device may attempt to isolate desired speech associated with the user from undesired speech associated with other users and/or other sources of noise, such as audio generated by loudspeaker(s) or ambient noise in an environment around the device.

To improve an audio quality of the audio data, the device may perform Acoustic Wave Decomposition (AWD) processing, which enables the device to map the audio data into directional components and/or perform additional audio processing. For example, the device can use the AWD processing to improve beamforming, sound source localization, sound source separation, and/or the like. Additionally or alternatively, the device may use the AWD processing to perform dereverberation, acoustic mapping, and/or sound field reconstruction.

To improve processing of the device, offered is a technique for performing a two-stage iterative method to reduce a complexity of solving the acoustic wave decomposition problem. The improved method reduces a complexity of solving the AWD problem, requiring less processing power, by splitting the solution to two phases: a search phase and a decomposition phase. The search phase selects a subset of the device dictionary to reduce a complexity, and the decomposition phase solves an optimization problem using the subset of the device dictionary. Solving the optimization problem allows the device to decompose an observed sound field into directional components, enabling the device to perform additional processing such as beamforming, sound source localization, sound source separation, dereverberation, acoustic mapping, and/or sound field reconstruction.

Figure 1:
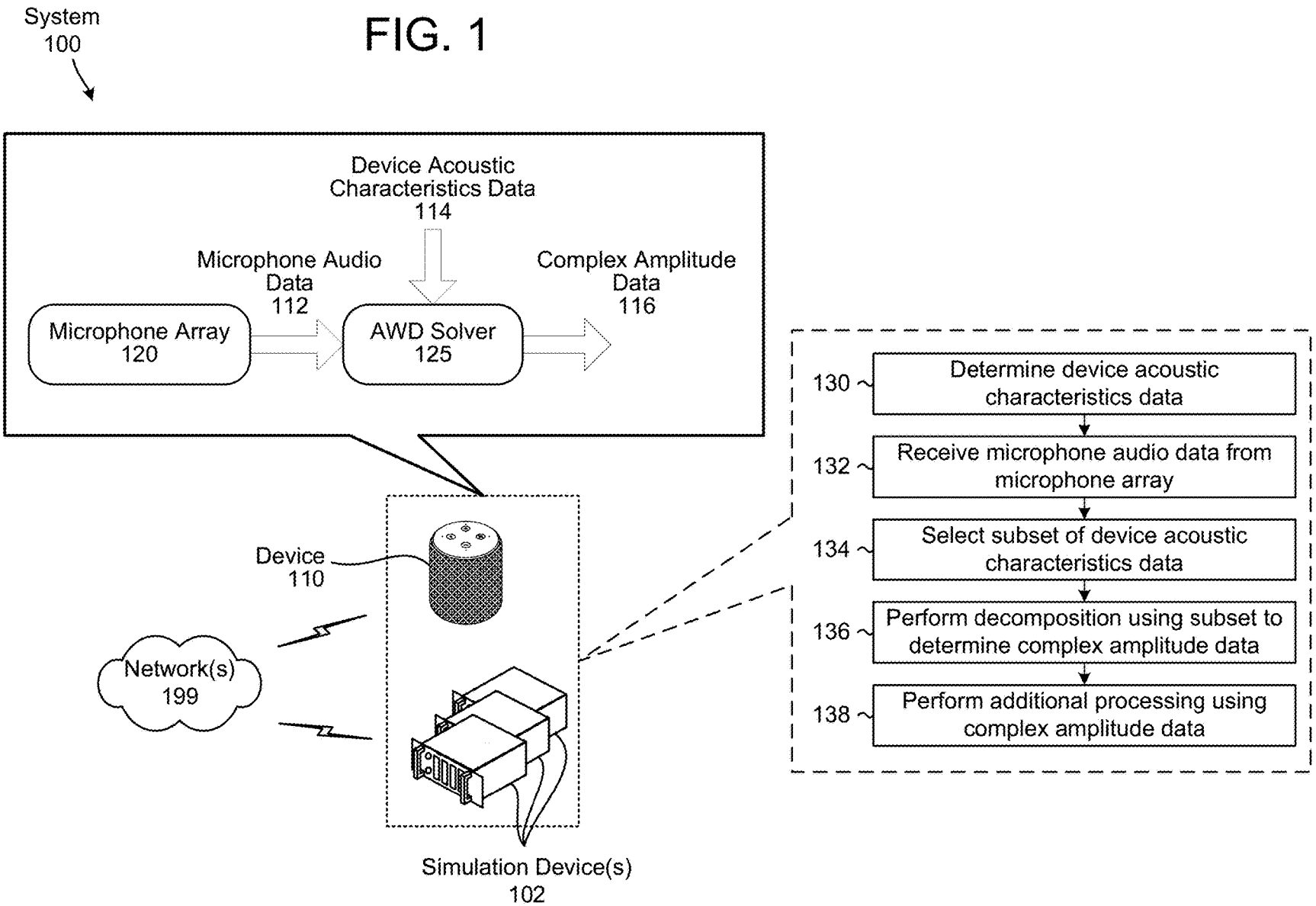
FIG. 1 illustrates system configured to perform acoustic wave decomposition according to embodiments of the present disclosure.

FIG. 1 illustrates a system configured to perform acoustic wave decomposition according to embodiments of the present disclosure. Although FIG. 1, and other figures/discussion illustrate the operation of the system 100 in a particular order, the steps described may be performed in a different order (as well as certain steps removed or added) without departing from the intent of the disclosure.

As illustrated in FIG. 1, the system 100 may comprise a device 110 and/or one or more simulation device(s) 102, which may be communicatively coupled to network(s) 199 and/or other components of the system 100. The device 110 may include a microphone array 120 configured to generate microphone audio data 112. The device 110 and/or the simulation device(s) 102 may include an Acoustic Wave Decomposition (AWD) solver component 125 configured to perform AWD processing to determine complex amplitude data 116. For example, FIG. 1 illustrates that the AWD solver component 125 may process the microphone audio data 112 and device acoustic characteristic data 114 to solve an optimization model in order to determine the complex amplitude data 116, as described in greater detail below with regard to FIG. 6.

As described in greater detail below with regard to FIGS. 4A-4C, the device acoustic characteristics data 114 (e.g., device dictionary) may be calculated once for a given device (e.g., device 110 or a prototype device including a microphone array). The device acoustic characteristics data 114 represents the acoustic response of the device to each acoustic plane-wave of interest, completely characterizing the device behavior for each acoustic plane-wave. Thus, the system 100 may use the device acoustic characteristics data 114 to accommodate for the acoustic wave scattering due to the device surface. Each entry of the device acoustic characteristics data 114 has the form $\{z(\omega,\phi,\theta)\}_{\omega,\phi,\theta}$, which represents the acoustic pressure vector (at all microphones) at frequency $\omega$, for an acoustic plane-wave of elevation $\phi_1$ and azimuth $\theta_1$. Thus, a length of each entry of the device acoustic characteristics data 114 corresponds to a number of microphones included in the microphone array.

As illustrated in FIG. 1, the system 100 may generate the complex amplitude data 116 using the device 110 and/or the simulation device(s) 102. For example, the device 110 may generate the complex amplitude data 116 during normal operation, whereas the simulation device(s) 102 may generate the complex amplitude data 116 while simulating a potential microphone array. For ease of explanation, the disclosure may refer to the AWD solver component 125 generating the complex amplitude data 116 whether the complex amplitude data 116 is generated during operation of the device 110 or during a simulation generated by the simulation device(s) 102 without departing from the disclosure.

In some examples, the device 110 may be configured to generate the complex amplitude data 116 corresponding to a microphone array of the device 110. Thus, the device 110 may generate the complex amplitude data 116 and then use the complex amplitude data 116 to perform additional processing. For example, the device 110 may use the complex amplitude data 116 to beamforming, sound source localization, sound source separation, dereverberation, acoustic mapping, sound field reconstruction, and/or the like, as described in greater detail below with regard to FIG. 5.

The disclosure is not limited thereto, however, and in other examples the simulation device(s) 102 may be configured to perform a simulation of a microphone array to generate the complex amplitude data 116. Thus, the one or more simulation device(s) 102 may perform a simulation of a microphone array in order to evaluate the microphone array. For example, the system 100 may simulate how the selected microphone array will capture audio in a particular room by estimating a room impulse response (RIR) corresponding to the selected microphone array being at a specific location in the room. Using the RIR data, the system 100 may simulate a potential microphone array associated with a prototype device prior to actually building the prototype device, enabling the system 100 to evaluate a plurality of microphone array designs having different geometries and select a potential microphone array based on the simulated performance of the potential microphone array. However, the disclosure is not limited thereto and the system 100 may evaluate a single potential microphone array, an existing microphone array, and/or the like without departing from the disclosure.

In some examples, the simulation device(s) 102 may correspond to a server. The term "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The server(s) may be configured to operate using one or more of a client-server model, a computer bureau model, grid computing techniques, fog computing techniques, mainframe techniques, utility computing techniques, a peer-to-peer model, sandbox techniques, or other computing techniques.

The network(s) 199 may include a local or private network and/or may include a wide network such as the Internet. The device(s) 110/102 may be connected to the network(s) 199 through either wired or wireless connections. For example, the device 110 may be connected to the network(s) 199 through a wireless service provider, over a WiFi or cellular network connection, and/or the like. Other devices may be included as network-connected support devices, such as the simulation device(s) 102, and may connect to the network(s) 199 through a wired connection and/or wireless connection without departing from the disclosure.

As is known and as used herein, "capturing" an audio signal and/or generating audio data includes a microphone transducing audio waves (e.g., sound waves) of captured sound to an electrical signal and a codec digitizing the signal to generate the microphone audio data.

As illustrated in FIG. 1, the system 100 may determine (130) device acoustic characteristics data 114. As the device acoustic characteristics data 114 only need to be determined once for a particular microphone array, the system 100 may retrieve the device acoustic characteristics data 114 from a storage device without departing from the disclosure. In addition, the system 100 may receive (132) microphone audio data from the microphone array 120.

Using the microphone audio data 112 and the device acoustic characteristics data 114, the system 100 may select (134) a subset of the device acoustic characteristics data 114 and may perform (136) decomposition using the subset to determine the complex amplitude data 116, as described in greater detail below with regard to FIG. 6. For example, the system 100 may generate an optimization model and may solve the optimization model using a regularization function to determine the complex amplitude data 116. Finally, the system 100 may perform (138) additional processing using the complex amplitude data 116. For example, solving the optimization problem allows the device to decompose an observed sound field into directional components, enabling the device to use the device acoustic characteristics data 114 and the complex amplitude data 116 in order to perform additional processing such as beamforming, sound source localization, sound source separation, dereverberation, acoustic mapping, and/or sound field reconstruction.

Acoustic theory tells us that a point source produces a spherical acoustic wave in an ideal isotropic (uniform) medium such as air. Further, the sound from any radiating surface can be computed as the sum of spherical acoustic wave contributions from each point on the surface, including any relevant reflections. In addition, acoustic wave propagation is the superposition of spherical acoustic waves generated at each point along a wavefront. Thus, all linear acoustic wave propagation can be seen as a superposition of spherical traveling waves.

Figure 2B:
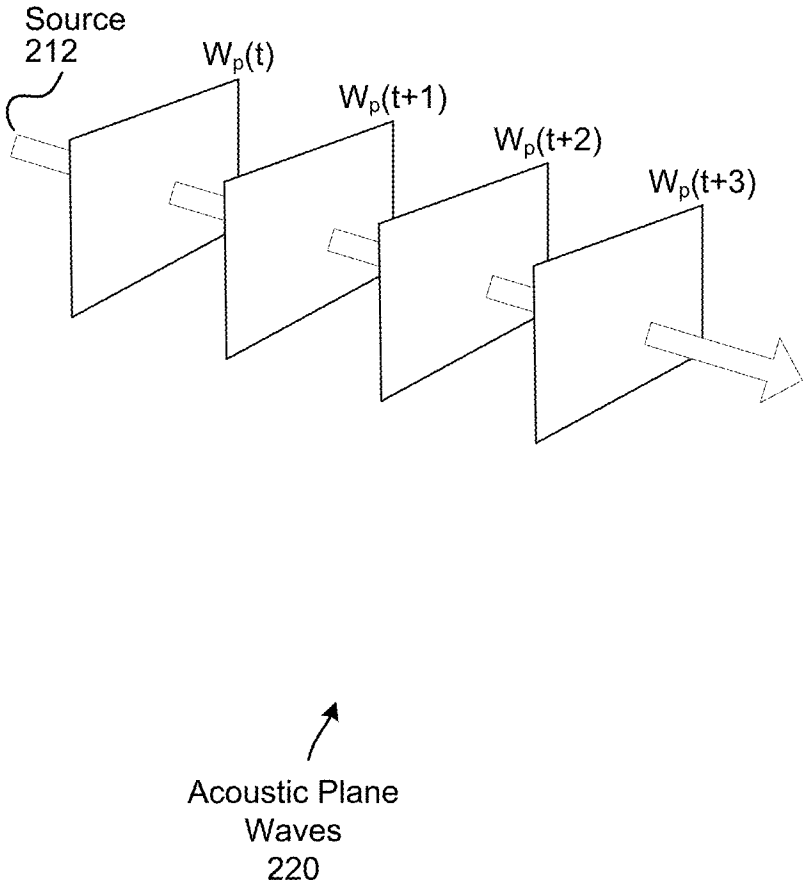
FIGS. 2A-2B illustrate examples of acoustic wave propagation.
Figure 2A:
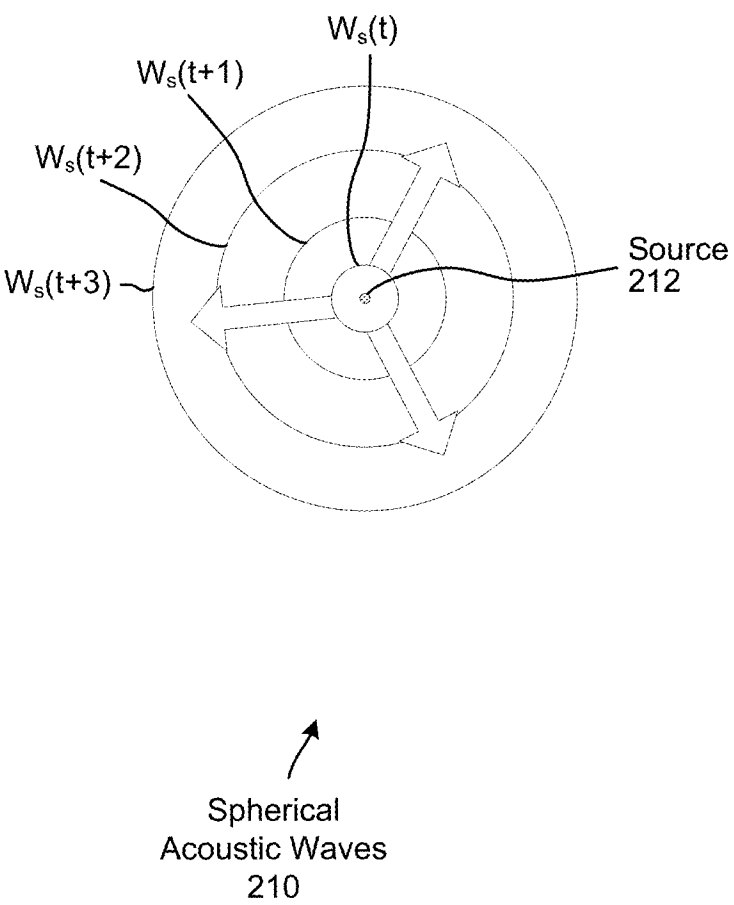

FIGS. 2A-2B illustrate examples of acoustic wave propagation. As illustrated in FIG. 2A, spherical acoustic waves 210 (e.g., spherical traveling waves) correspond to a wave whose wavefronts (e.g., surfaces of constant phase) are spherical (e.g., the energy of the wavefront is spread out over a spherical surface area). Thus, the source 212 (e.g., radiating sound source, such as a loudspeaker) emits spherical traveling waves in all directions, such that the spherical acoustic waves 210 expand over time. This is illustrated in FIG. 2A as a spherical wave $w_s$ with a first arrival having a first radius at a first time $w_s(t)$, a second arrival having a second radius at a second time $w_s(t+1)$, a third arrival having a third radius at a third time $w_s(t+2)$, a fourth arrival having a fourth radius at a fourth time $w_s(t+3)$, and so on.

Additionally or alternatively, acoustic waves can be visualized as rays emanating from the source 212, especially at a distance from the source 212. For example, the acoustic waves between the source 212 and the microphone array can be represented as acoustic plane waves. As illustrated in FIG. 2B, acoustic plane waves 220 (e.g., planewaves) correspond to a wave whose wavefronts (e.g., surfaces of constant phase) are parallel planes. Thus, the acoustic plane waves 220 shift with time t from the source 212 along a direction of propagation (e.g., in a specific direction), represented by the arrow illustrated in FIG. 2B. This is illustrated in FIG. 2B as a plane wave $w_p$ having a first position at a first time $w_p(t)$, a second position at a second time $w_p(t+1)$, a third position at a third time $w_p(t+2)$, a fourth position at a fourth time $w_p(t+3)$, and so on. While not illustrated in FIG. 2B, acoustic plane waves may have a constant value of magnitude and a linear phase, corresponding to a constant acoustic pressure.

Acoustic plane waves are a good approximation of a far-field sound source (e.g., sound source at a relatively large distance from the microphone array), whereas spherical acoustic waves are a better approximation of a near-field sound source (e.g., sound source at a relatively small distance from the microphone array). For ease of explanation, the disclosure may refer to acoustic waves with reference to acoustic plane waves. However, the disclosure is not limited thereto, and the illustrated concepts may apply to spherical acoustic waves without departing from the disclosure. For example, the device acoustic characteristics data may correspond to acoustic plane waves, spherical acoustic waves, and/or a combination thereof without departing from the disclosure.

Figure 3:
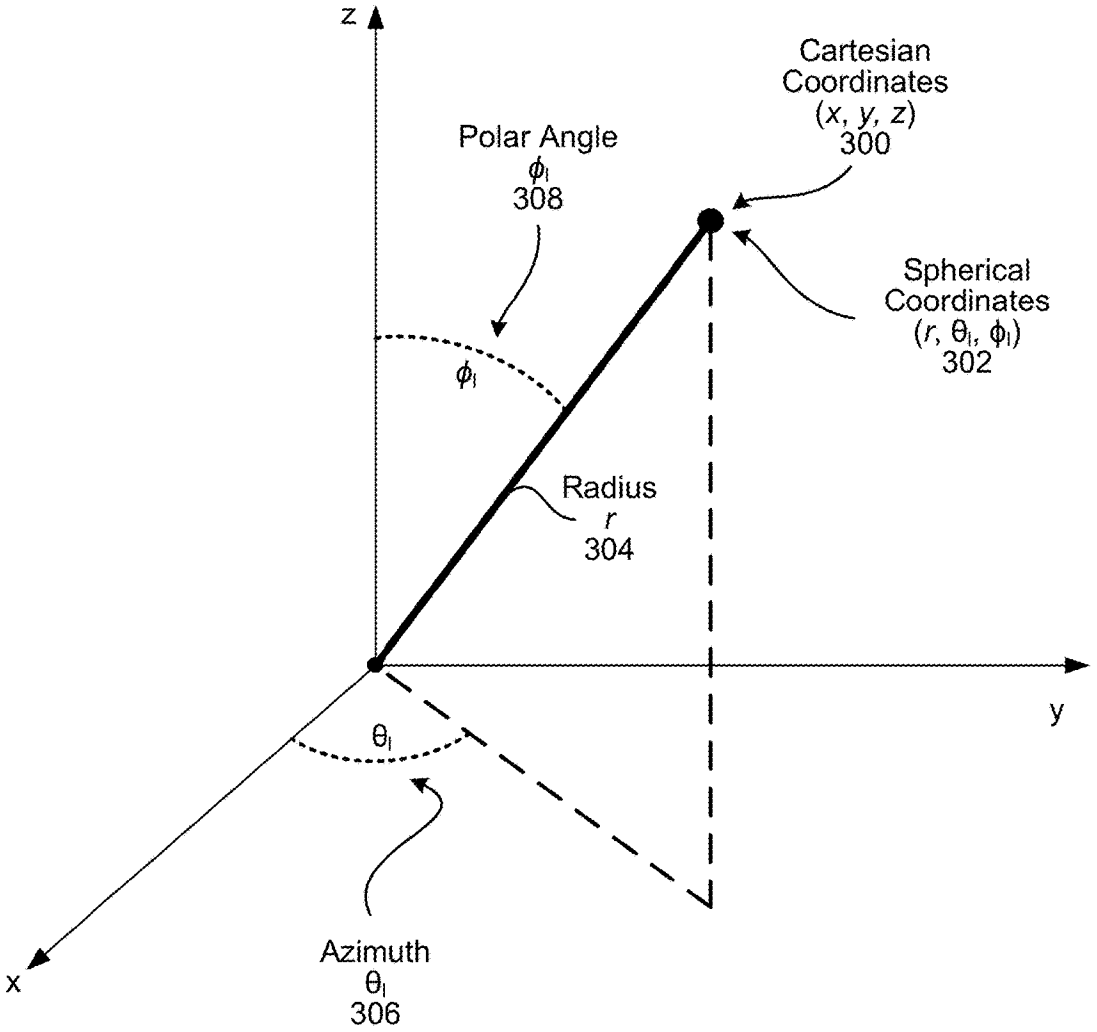
FIG. 3 illustrates an example of spherical coordinates.

FIG. 3 illustrates an example of spherical coordinates, which may be used throughout the disclosure with reference to acoustic waves relative to the microphone array. As illustrated in FIG. 3, Cartesian coordinates (x, y, z) 300 correspond to spherical coordinates (r, $\theta_1$, $\phi_1$) 302. Thus, using Cartesian coordinates, a location may be indicated as a point along an x-axis, a y-axis, and a z-axis using coordinates (x, y, z), whereas using spherical coordinates the same location may be indicated using a radius r 304, an azimuth $\phi_1$ 306 and a polar angle $\phi_1$ 308. The radius r 304 indicates a radial distance of the point from a fixed origin, the azimuth $\theta_1$ 306 indicates an azimuth angle of its orthogonal projection on a reference plane that passes through the origin and is orthogonal to a fixed zenith direction, and the polar angle $\phi_1$ 308 indicates a polar angle measured from the fixed zenith direction. Thus, the azimuth $\theta_1$ 306 varies between 0 and 360 degrees, while the polar angle $\phi_1$ 308 varies between 0 and 180 degrees.

Figure 4A:
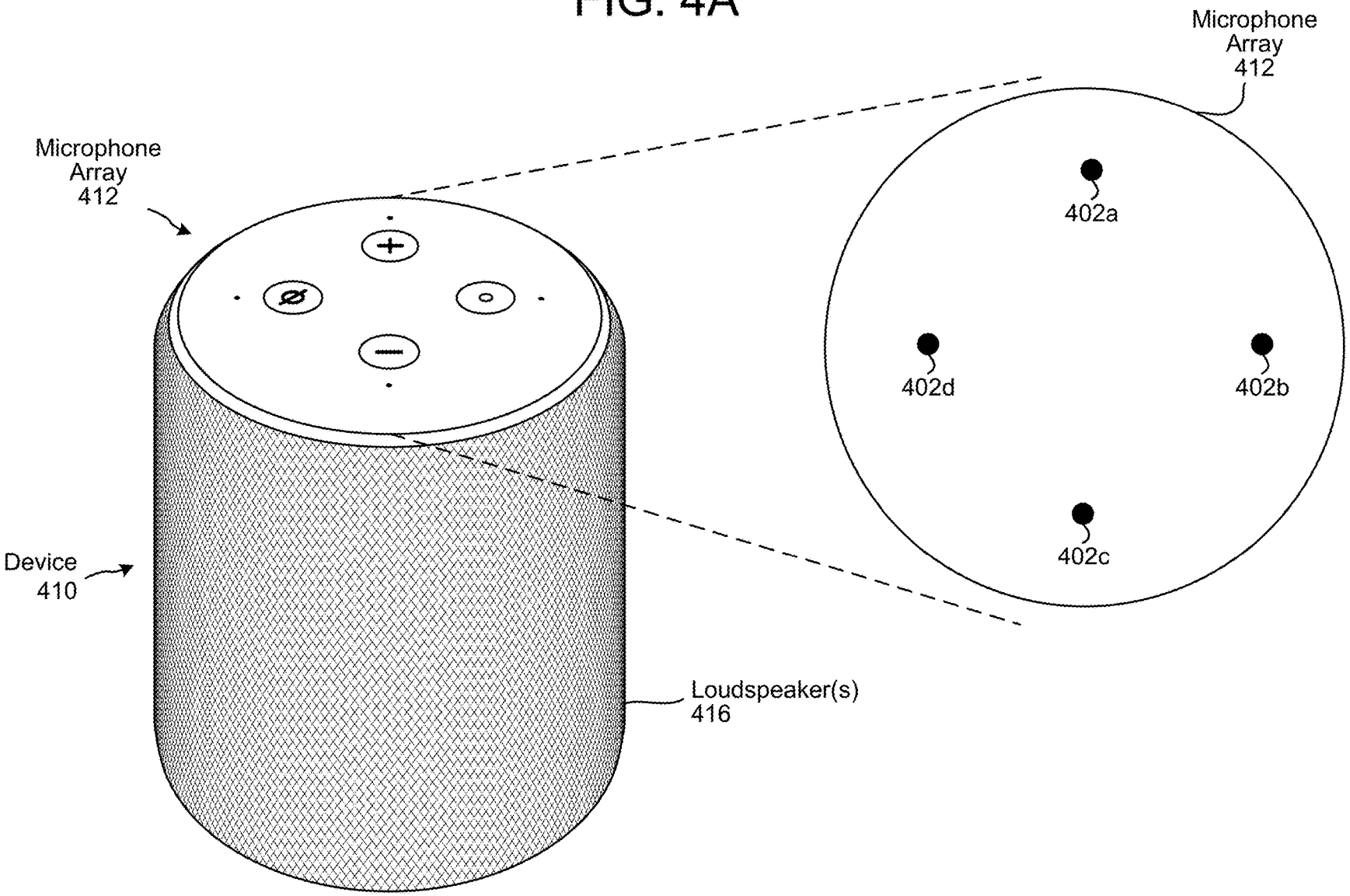
FIGS. 4A-4C illustrate a device having a microphone array and examples of determining a device response via simulation or measurement according to embodiments of the present disclosure.
Figure 4B:
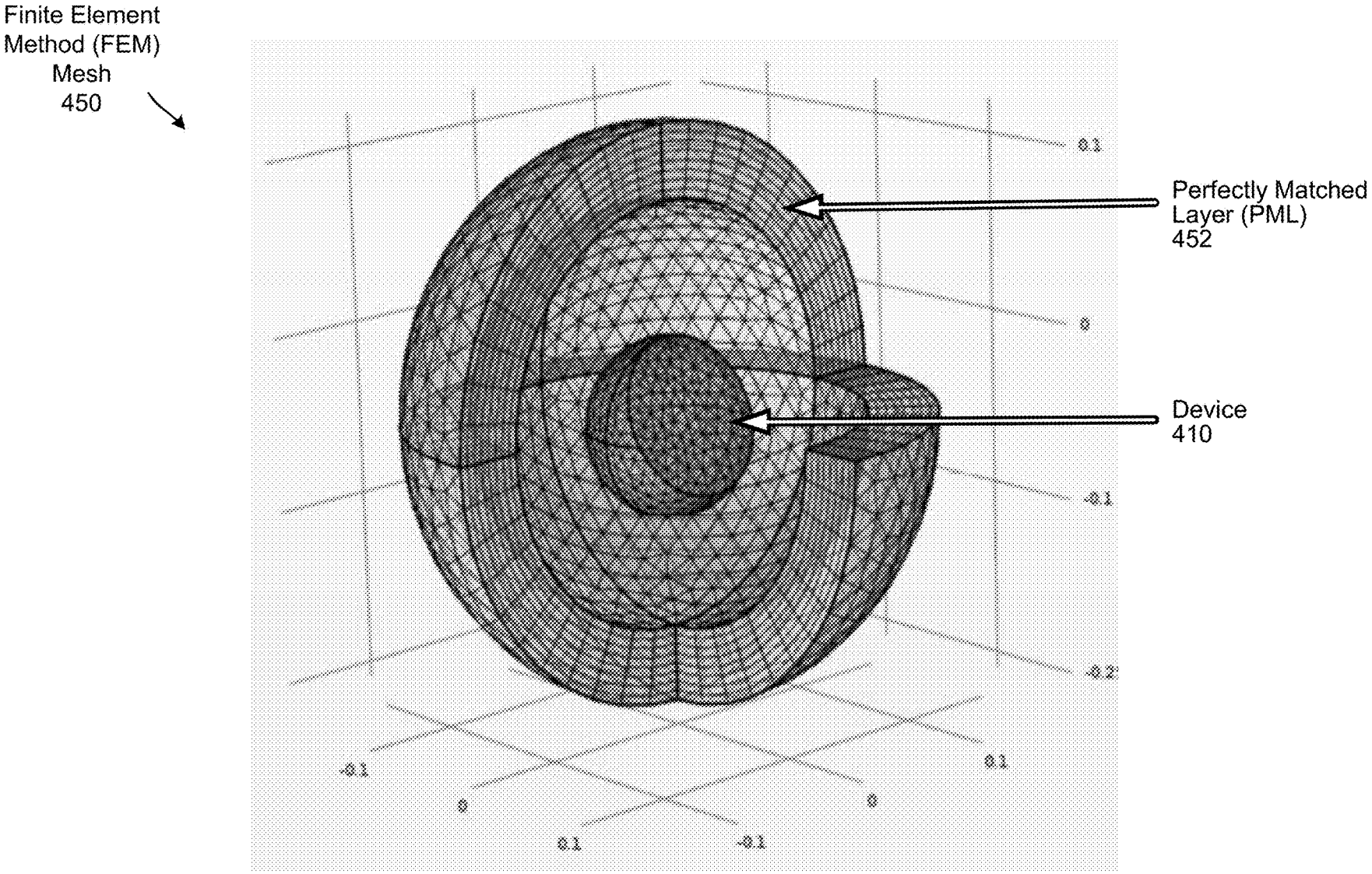
Figure 4C:
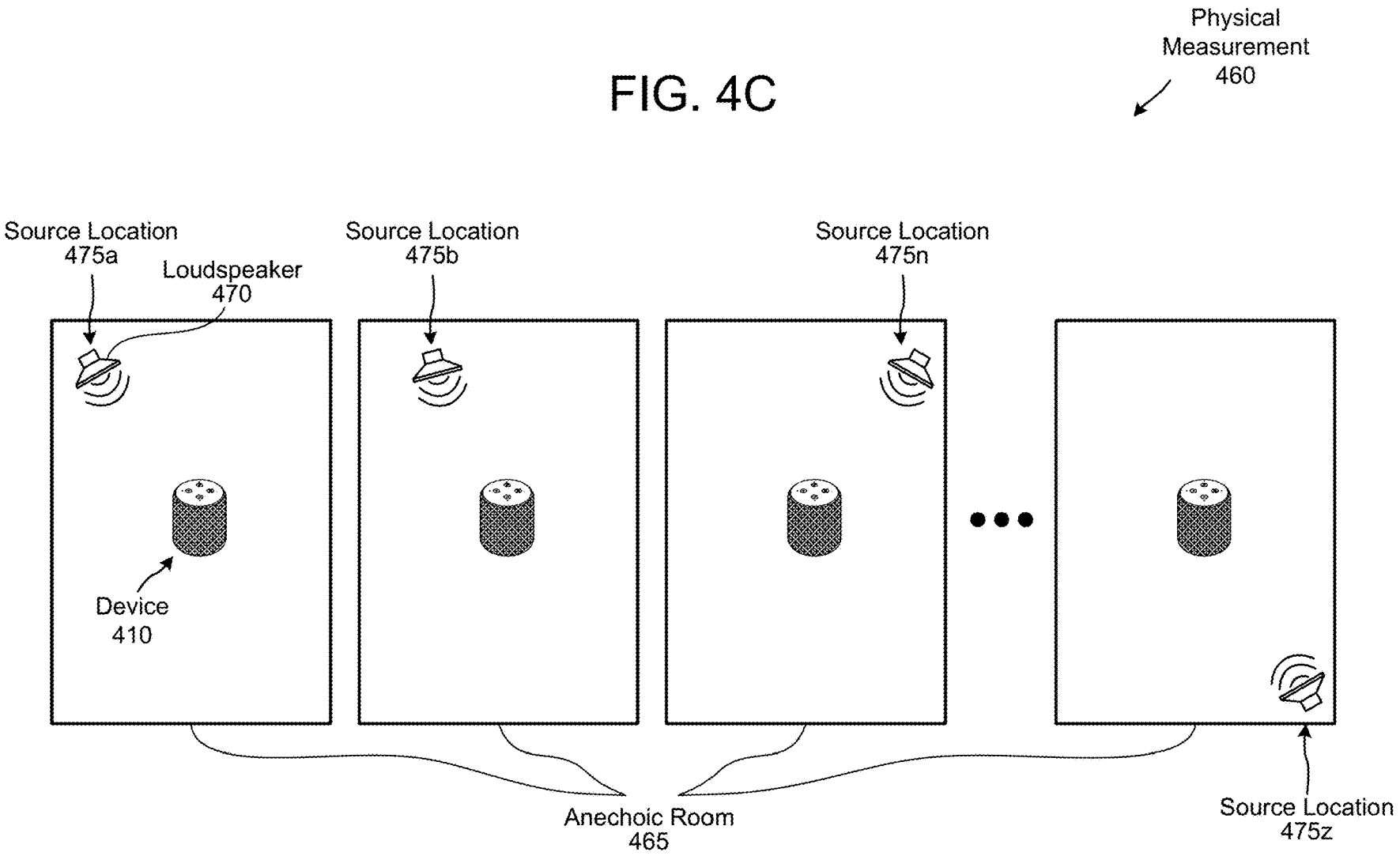

FIGS. 4A-4C illustrate a device having a microphone array and examples of determining a device response via simulation or measurement according to embodiments of the present disclosure. As illustrated in FIG. 4A, a device 410 may include, among other components, a microphone array 412, one or more loudspeaker(s) 416, and other components not illustrated in FIG. 4A. The microphone array 412 may include a number of different individual microphones 402. In the example configuration illustrated in FIG. 4A, the microphone array 412 includes four (4) microphones 402*a*-402*d*, although the disclosure is not limited thereto and the number of microphones 402 may vary without departing from the disclosure.

In some examples, the device 410 illustrated in FIG. 4A may correspond to the device 110 described above with regard to FIG. 1. For example, the system 100 may determine device acoustic characteristics data 114 associated with the device 110 and the device 110 may use the device acoustic characteristics data 114 to generate RIR data during operation. However, the disclosure is not limited thereto, and in other examples the device 410 may correspond to a prototype of a device to be simulated by the simulation device(s) 102 without departing from the disclosure.

The acoustic wave equation is the governing law for acoustic wave propagation in fluids, including air. In the time domain, the homogenous wave equation has the form:

$$\nabla^2 \overline{p} - \frac{1}{c^2}\frac{\partial^2 \overline{p}}{\partial t^2} = 0 \quad [1a]$$

where p(t) is the acoustic pressure and c is the speed of sound in the medium. Alternatively, the acoustic wave equation may be solved in the frequency domain using the Helmholtz equation to find p(f):

$$\nabla^2 p + k^2 p = 0 \quad [1b]$$

where $k \triangleq 2\pi f/c$ is the wave number. At steady state, the time-domain and the frequency-domain solutions are Fourier pairs. The boundary conditions are determined by the geometry and the acoustic impedance of the difference boundaries. The Helmholtz equation is typically solved using Finite Element Method (FEM) techniques, although the disclosure is not limited thereto and the device 110 may solve using boundary element method (BEM), finite difference method (FDM), and/or other techniques without departing from the disclosure.

To analyze the microphone array 412, the system 100 may determine device acoustic characteristics data 114 associated with the device 410. For example, the device acoustic characteristics data 114 represents scattering due to the device surface (e.g., acoustic plane wave scattering caused by a surface of the device 410). Therefore, the system 100 needs to compute the scattered field at all microphones 402 for each plane-wave of interest impinging on a surface of the device 410. The total wave-field at each microphone of the microphone array 412 when an incident plane-wave $p_i(k)$ impinges on the device 410 has the general form:

$$p_t = p_i + p_s \quad [2]$$

where $p_t$ is the total wave-field, $p_i$ is the incident plane-wave, and $p_s$ is the scattered wave-field.

The device acoustic characteristics data 114 may represent the acoustic response of the device 410 associated with the microphone array 412 to each acoustic wave of interest. The device acoustic characteristics data 114 may include a plurality of vectors, with a single vector corresponding to a single acoustic wave. The number of acoustic waves may vary, and in some examples the acoustic characteristics data may include acoustic plane waves, spherical acoustic waves, and/or a combination thereof. In some examples, the device acoustic characteristics data 114 may include 1024 frequency bins (e.g., frequency ranges) up to a maximum frequency (e.g., 8 kHz, although the disclosure is not limited thereto). Thus, the system 100 may use the device acoustic characteristics data 114 to generate RIR data with a length of up to 2048 taps, although the disclosure is not limited thereto.

The entries (e.g., values) for a single vector represent an acoustic pressure indicating a total field at each microphone (e.g., incident acoustic wave and scattering caused by the microphone array) for a particular background acoustic wave. Each entry of the device acoustic characteristics data 114 has the form $\{z(\omega,\phi,\theta)\}_{\omega,\phi,\theta}$, which represents the acoustic pressure vector (at all microphones) at frequency $\omega$, for an acoustic wave of elevation $\phi_1$ and azimuth $\theta_1$. Thus, a length of each entry of the device acoustic characteristics data 114 corresponds to a number of microphones included in the microphone array.

These values may be simulated by solving a Helmholtz equation or may be directly measured using a physical measurement in an anechoic room (e.g., a room configured to deaden sound, such that there is no echo) with a distance point source (e.g., loudspeaker). For example, using techniques such as finite element method (FEM), boundary element method (BEM), finite difference method (FDM), and/or the like, the system 100 may calculate the total wave-field at each microphone. Thus, a number of entries in each vector corresponds to a number of microphones in the microphone array, with a first entry corresponding to a first microphone, a second entry corresponding to a second microphone, and so on.

In some examples, the system 100 may determine the device acoustic characteristics data 114 by simulating the microphone array 412 using wave-based acoustic modeling. For example, FIG. 4B illustrates an example using a finite element method (FEM), which models the device 410 using a FEM mesh 450. To have a true background acoustic wave, the external boundary should be open and non-reflecting. To mimic an open-ended boundary, the system 100 may use a perfectly matched layer (PML) 452 to define a special absorbing domain that eliminates reflection and refractions in the internal domain that encloses the device 410. While FIG. 4B illustrates using FEM processing, the disclosure is not limited thereto and the system 100 may use boundary element method (BEM) processing and/or other wave-based acoustic modeling techniques without departing from the disclosure.

The system 100 may calculate the total wave-field at all frequencies of interest with a background acoustic wave, where the surface of the device 410 is modeled as a sound hard boundary. If a surface area of an individual microphone is much smaller than a wavelength of the acoustic wave, the microphone is modeled as a point receiver on the surface of the device 410. If the surface area is not much smaller than the wavelength, the microphone response is computed as an integral of the acoustic pressure over the surface area.

Using the FEM model, the system 100 may calculate an acoustic pressure at each microphone (at each frequency) by solving the Helmholtz equation numerically with a background acoustic wave. This procedure is repeated for each possible acoustic wave and each possible direction to generate a full dictionary that completely characterizes a behavior of the device 410 for each acoustic wave (e.g., device response for each acoustic wave). Thus, the system 100 may simulate the device acoustic characteristics data 114 and may apply the device acoustic characteristics data 114 to any room configuration.

In other examples, the system 100 may determine the device acoustic characteristics data 114 described above by physical measurement 460 in an anechoic room 465, as illustrated in FIG. 4C. For example, the system 100 may measure acoustic pressure values at each of the microphones 402 in response to an input (e.g., impulse) generated by a loudspeaker 470. The input may correspond to white noise or other waveforms, and may include a frequency sweep across all frequency bands of interest (e.g., input signal includes white noise within all desired frequency bands).

To model all of the potential acoustic waves, the system 100 may generate the input using the loudspeaker 470 in all possible locations in the anechoic room 465. For example, FIG. 4C illustrates examples of the loudspeaker 470 generating inputs at multiple source locations 475 along a horizontal direction, such as a first input at a first source location 475*a*, a second input at a second source location 475*b*, and so on until an n-th input at an n-th source location 475*n*. This is intended to illustrate that the loudspeaker 470 generates the input at every possible source location 475 associated with a first horizontal row. In addition, the system 100 may generate the input using the loudspeaker 470 at every possible source location 475 in every horizontal row without departing from the disclosure. Thus, the loudspeaker 470 may generate inputs at every possible source location 475 throughout the anechoic room 465, until finally generating a z-th input at a z-th source location 475*z*.

Figure 5:
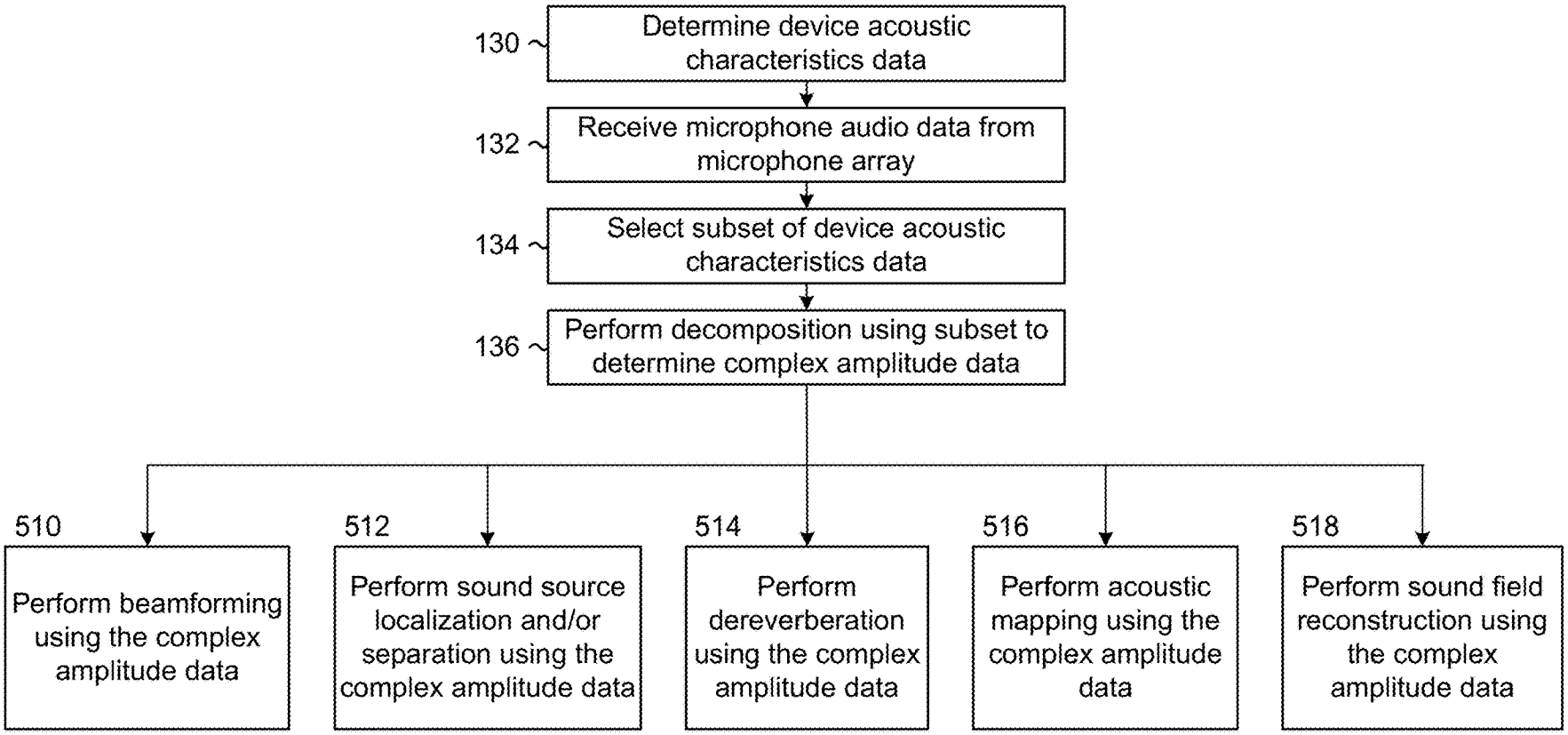
FIG. 5 is a flowchart conceptually illustrating example methods for performing additional processing using the complex amplitude data according to embodiments of the present disclosure.

FIG. 5 is a flowchart conceptually illustrating example methods for performing additional processing using the complex amplitude data according to embodiments of the present disclosure. As illustrated in FIG. 5, the device 110 may perform steps 130-136 to determine complex amplitude data 116, as described in greater detail above with regard to FIG. 1. As these steps are described above, a redundant description is omitted.

After determining the complex amplitude data 116, the device 110 may use the complex amplitude data 116 to perform a variety of functions. As illustrated in FIG. 5, in some examples the device 110 may perform (510) beamforming using the complex amplitude data 116. For example, the device 110 may perform acoustic beamforming based on the device acoustic characteristics data 114, the complex amplitude data 116, and/or the like, to distinguish between different directions relative to the microphone array 120. Additionally or alternatively, the device 110 may perform (512) sound source localization and/or separation using the complex amplitude data 116. For example, the device 110 may distinguish between multiple sound source(s) in the environment and generate audio data corresponding to each of the sound source(s), although the disclosure is not limited thereto. In some examples, the device 110 may perform (514) dereverberation using the complex amplitude data 116.

The device 110 may also perform (516) acoustic mapping using the complex amplitude data 116. In some examples, the device 110 may perform acoustic mapping such as generating a room impulse response (RIR). The RIR corresponds to an impulse response of a room or environment surrounding the device, such that the RIR is a transfer function of the room between sound source(s) and the microphone array 120 of the device 110. For example, the device 110 may generate the RIR by using the complex amplitude data 116 to determine an output signal corresponding to the sound source(s) and/or an input signal corresponding to the microphone array 120. The disclosure is not limited thereto, and in other examples, the device 110 may perform acoustic mapping to generate an acoustic map (e.g., acoustic source map, heatmap, and/or other representation) indicating acoustic sources in the environment. For example, the device 110 may locate sound source(s) in the environment and/or estimate their strength, enabling the device 110 to generate an acoustic map indicating the relative positions and/or strengths of each of the sound source(s). These sound source(s) include users within the environment, loudspeakers or other device(s) in the environment, and/or other sources of audible noise that the device 110 may detect.

Finally, the device 110 may perform (518) sound field reconstruction using the complex amplitude data 116. For example, the device 110 may perform sound field reconstruction to reconstruct a magnitude of sound pressure at various points in the room (e.g., spatial variation of the sound field), although the disclosure is not limited thereto. While FIG. 5 illustrates several examples of implementations that make use of the complex amplitude data 116, the disclosure is not limited thereto and the device 110 may use the complex amplitude data 116 in other techniques without departing from the disclosure. For example, the device 110 may use the complex amplitude data 116 to perform binaural rendering and/or the like without departing from the disclosure.

Figure 6:
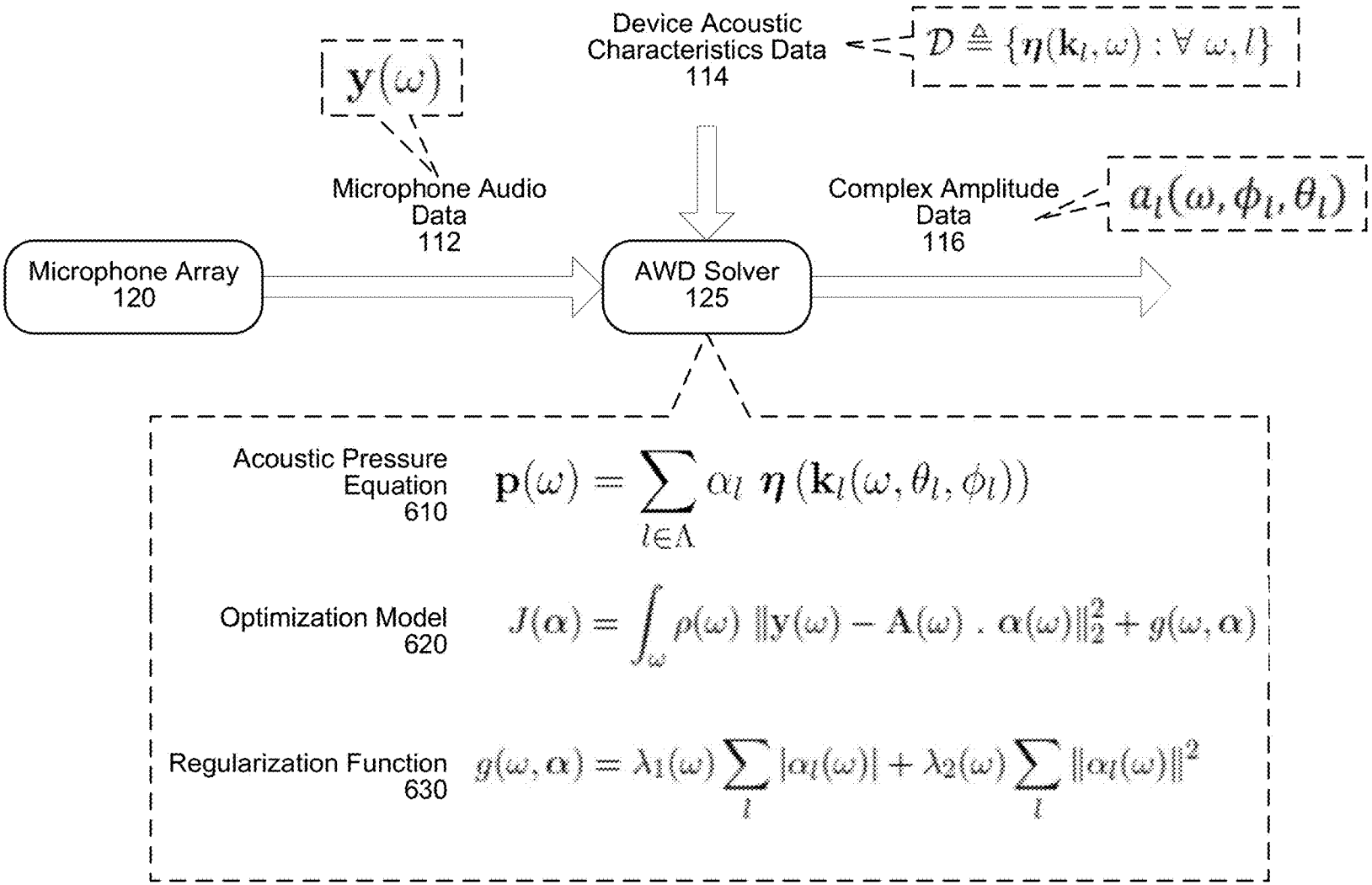
FIG. 6 illustrates an example of performing acoustic wave decomposition using a multi-stage solver according to embodiments of the present disclosure.

FIG. 6 illustrates an example of performing acoustic wave decomposition using a multi-stage solver according to embodiments of the present disclosure. As illustrated in FIG. 6, the microphone array 120 may generate microphone audio data 112 and the AED solver component 125 may use the microphone audio data 112 and the device acoustic characteristics data 114 to perform acoustic wave decomposition and determine the complex amplitude data 116.

As described above, the propagation of acoustic waves in nature is governed by the acoustic wave equation, whose representation in the frequency domain (e.g., Helmholtz equation), in the absence of sound sources, is illustrated in Equation [1b]. In this equation, $p(\omega)$ denotes the acoustic pressure at frequency $\omega$, and k denotes the wave number. Acoustic plane waves are powerful tools for analyzing the wave equation, as acoustic plane waves are a good approximation of the wave-field emanating from a far-field point source. The acoustic pressure of a plane-wave with vector wave number k is defined at point r=(x, y, z) in the three-dimensional space as:

$$\psi(k) \triangleq p_0 \epsilon^{-jk^T r} \quad [3]$$

where k is the three-dimensional wavenumber vector. For free-field propagation, k has the form:

$$k(\omega, \theta, \phi) = \frac{\omega}{c}\begin{pmatrix} \cos(\phi)\sin(\theta) \\ \sin(\theta)\sin(\theta) \\ \cos(\theta) \end{pmatrix} \quad [4]$$

where c is the speed of sound, and $\phi$ and $\theta$ are respectively the elevation and azimuth of the vector normal to the plane wave propagation. Note that k in Equation [1b] is $\|k\|$. A local solution to the homogenous Helmholtz equation can be approximated by a linear superposition of plane waves:

$$p(\omega) = \sum_{l \in \Lambda} \alpha_l \psi(k_l(\omega, \theta_l, \phi_l)) \quad [5]$$

where $\wedge$ is a set of indices that defines the directions of plane waves $\{\phi, \theta\}$, each $\varphi(k)$ is a plane wave as in Equation [3] with k as in Equation [4], and $\{\alpha_1\}$ are complex scaling factors (e.g., complex amplitude data 116) that are computed to satisfy the boundary conditions. In FIG. 6, the complex amplitude data 116 is illustrated as $\alpha_1(\omega, \phi_1, \theta_1)$, although the disclosure is not limited thereto. Even though the expansion in Equation [5] is derived using pure mathematical tools, it has an insightful physical interpretation, where the acoustic pressure at a point is represented as a superposition of pressure values due to far-field point sources.

When an incident plane wave $\varphi(k)$ impinges on a rigid surface, scattering takes effect on the surface. The total acoustic pressure at a set of points on the surface $\eta(k)$ is the superposition of incident acoustic pressure (e.g., free-field plane wave) and scattered acoustic pressure caused by the device 110. The total acoustic pressure $\eta(k)$ can be either measured in an anechoic room or simulated by numerically solving the Helmholtz equation with background acoustic plane wave $\varphi(k)$. If two incident plane waves (e.g., $\varphi(k_1)$ and $\varphi(k_2)$) impinge on the surface, then the resulting total acoustic pressure is $\eta i(k_1)+\eta(k_2)$. As a result, if the device 110 has a rigid surface and is placed at a point whose free-field sound field is expressed as in Equation [5], then the resulting acoustic pressure on the device surface is illustrated in FIG. 6 as acoustic pressure equation 610:

$$p(\omega) = \sum_{l \in \Lambda} \alpha_1 \eta(k_l(\omega, \theta_l, \phi_l)) \quad [6]$$

where the free-field acoustic plane waves $\varphi(k_1)$ in Equation [5] are replaced by their fingerprints on the rigid surface $\{\eta(k_1)\}$ while preserving the angle directions $\{(\phi_1, \theta_1)\}$ and the corresponding weights $\{\alpha_1\}$. This preservation of incident directions on a rigid surface is key to enabling the optimization solution described below. In Equation [6], secondary reflections (e.g., where scatterings from the surface hit other surrounding surfaces and come back to the surface) are ignored. This is an acceptable approximation when the device 110 does not significantly alter the sound-field in the room, such as when the device dimensions are much smaller than the room dimensions. Note that the acoustic pressure $p(\omega)$ in Equation [6] could be represented by free-field plane waves (e.g., $\varphi(k_1)$, where the scattered field is modeled by free-field plane waves. However, this would abstract the components of Equation [6] to a mathematical representation without any significance to the device 110.

To enable the generalized representation in Equation [6], the fingerprint $\eta(k)$ of each acoustic plane wave $\varphi(k)$ is calculated at relevant points on the device surface (e.g., at the microphone array 112). The ensemble of all fingerprints of free-field plane waves may be referred to as the acoustic dictionary of the device (e.g., device acoustic characteristics data 114). Each entry of the device dictionary can be either measured in an anechoic room with single-frequency far-field sources, or computed numerically by solving the Helmholtz equation on the device surface with background plane-wave using a simulation or model of the device (e.g., computer-assisted design (CAD) model). Both methods yield the same result, but the numerical method has a lower cost and is less error-prone because it does not require human labor. For the numerical method, each entry in the device dictionary is computed by solving the Helmholtz equation, using Finite Element Method (FEM) techniques, Boundary Element Method (BEM) techniques, and/or the like, for the total field at the microphones with a given background plane wave $\varphi(k)$. The device model is used to specify the boundary in the simulation, and it is modeled as a sound hard boundary. To have a true background plane-wave, the external boundary should be open and non-reflecting. In the simulation, the device is enclosed by a closed boundary (e.g., a cylinder or spherical surface. To mimic an open-ended boundary, the simulation may use a Perfectly Matched Layer (PML) that defines a special absorbing domain that eliminates reflection and refractions in the internal domain that encloses the device. The acoustic dictionary (e.g., device acoustic characteristics data 114) has the form:

$$\mathcal{D} \triangleq \{\eta(k_1,\omega):\forall\omega,l\} \quad [7]$$

where each entry in the dictionary is a vector whose size equals the microphone array size, and each element in the vector is the total acoustic pressure at one microphone in the microphone array when a plane wave with $k(\omega_1,\phi_1,\theta_1)$ hits the device 110. The dictionary also covers all frequencies of interest, which may be up to 8 kHz but the disclosure is not limited thereto. The dictionary discretizes the azimuth and elevation angles in the three-dimensional space, with angle resolution typically less than 10°. Therefore, the device dictionary may include roughly 800 entries (e.g., |D|~800 entries).

The objective of the decomposition algorithm is to find the best representation of the observed sound field (e.g., microphone audio data 112 y(ω)) at the microphone array 120, using the device dictionary D. A least-square formulation can solve this optimization problem, where the objective is to minimize:

$$J(\alpha) = \int_{\omega} p(\omega)\left\| y(\omega) - \sum_{l\in\Lambda} \alpha_l(\omega)\eta_l(\omega)\right\|_2^2 + g(\omega, \alpha) \quad [8]$$

where g(.) is a regularization function and p(.) is a weighting function. An equivalent matrix form (e.g., optimization model 620) is:

$$J(\alpha) = \int_{\omega} p(\omega)\|y(\omega) - A(\omega)\cdot\alpha(\omega)\|_2^2 + g(\omega, \alpha) \quad [9]$$

where the columns of A(ω) are the individual entries of the acoustic dictionary at frequency ω (e.g., $\eta_1(\omega)$). In Equation [8], A refers to the nonzero indices of the dictionary entries, which represent directions in the three-dimensional space, and is independent of ω. This independents stems from the fact that when a sound source emits broadband frequency content, it is reflected by the same boundaries in its propagation path to the receiver. Therefore, all frequencies have components from the same directions but with different strengths (e.g., due to the variability of reflection index with frequency), which is manifested by the components $\{\alpha_1(\omega))\}$. Each component is a function of the source signal, the overall length of the acoustic path of its direction, and the reflectivity of the surfaces across its path. This independent between $\Lambda$ and ω is a key property in characterizing the optimization problem in Equation [9].

The typical size of an acoustic dictionary is ~$10^3$ entries, which corresponds to an azimuth resolution of 5° and an elevation resolution of 10°. In a typical indoor environment, approximately 20 acoustic plane waves are sufficient for a good approximation in Equation [6]. Moreover, the variability in the acoustic path of the different acoustic waves at each frequency further reduces the effective number of acoustic waves at individual frequencies. Hence, the optimization problem in Equation [9] is a sparse recovery problem and proper regularization is needed to stimulate a sparse a. This requires L1-regularization, such as the L1-regularization used in standard least absolute shrinkage and selection operator (LASSO) optimization. To improve the perceptual quality of the reconstructed audio, L2-regularization is added, and the regularization function g(α) (e.g., regularization function 630) has the general form of elastic net regularization:

$$g(\omega, a) = \lambda_1(\omega)\sum_l |\alpha_l(\omega)| + \lambda_2(\omega)\sum_l \|\alpha_l(\omega)\|^2 \quad [10]$$

The strategy for solving the elastic net optimization problem in Equation [9] depends on the size of the microphone array. If the microphone array size is big (e.g., greater than 20 microphones), then the observation vector is bigger than the typical number of nonzero components in α, making the problem relatively simple with several efficient solutions. However, the problem becomes much harder when the microphone array is relatively small (e.g., fewer than 10 microphones). In this case, the optimization problem at each frequency ω becomes an undetermined least-square problem because the number of observations is less than the expected number of nonzero elements in the output. Thus, the elastic net regularization illustrated in Equation [10] is necessary. Moreover, the invariance of directions (e.g., indices of nonzero elements $\Lambda$) with frequency could be exploited to reduce the search space for a more tractable solution, which is computed in two steps. Two example methods for solving this optimization problem are illustrated in FIGS. 8-7, as described in greater detail below.

Figure 7:
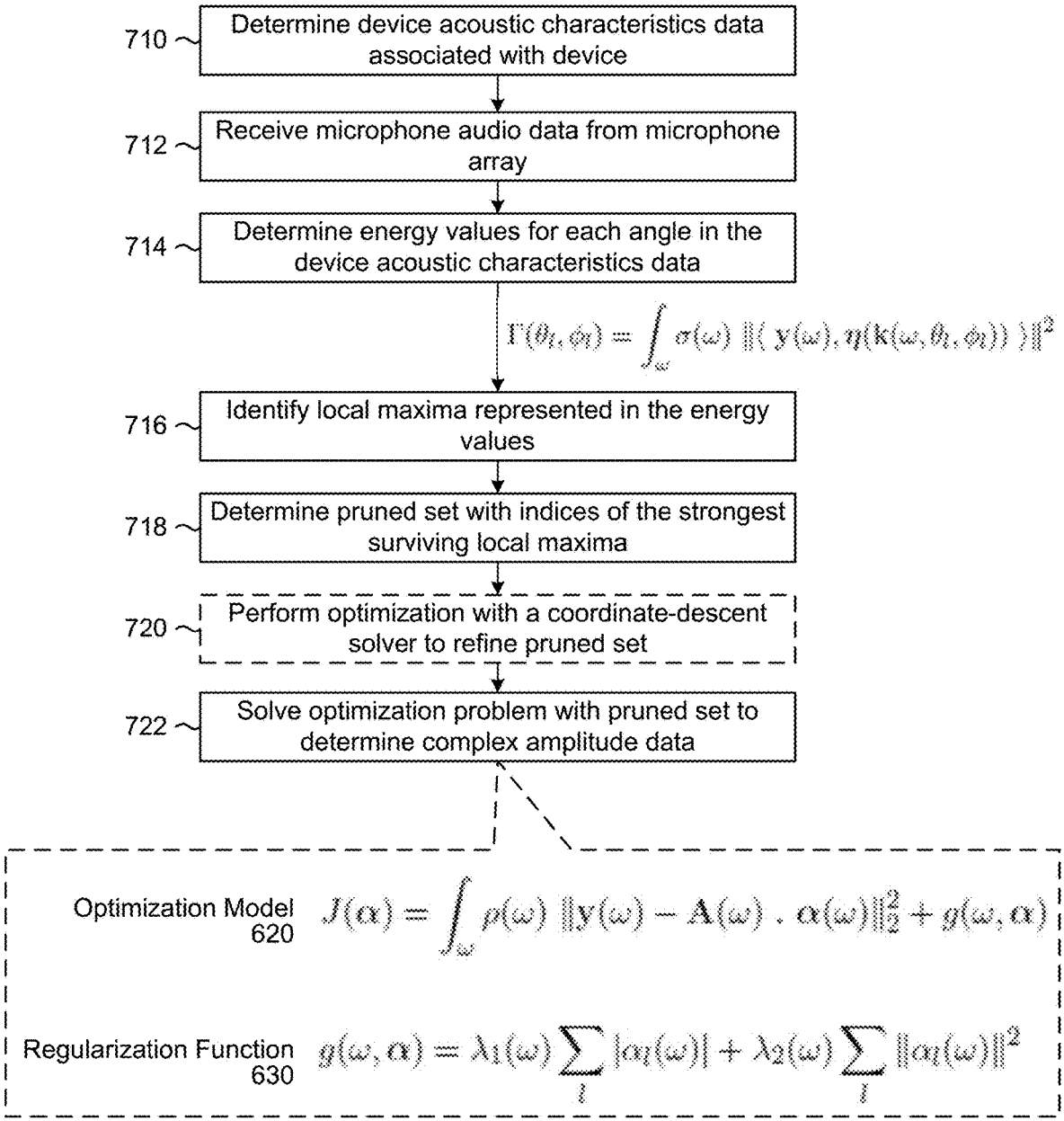
FIG. 7 is a flowchart conceptually illustrating an example method for performing acoustic wave decomposition to determine complex amplitude data according to embodiments of the present disclosure.
Figure 8:
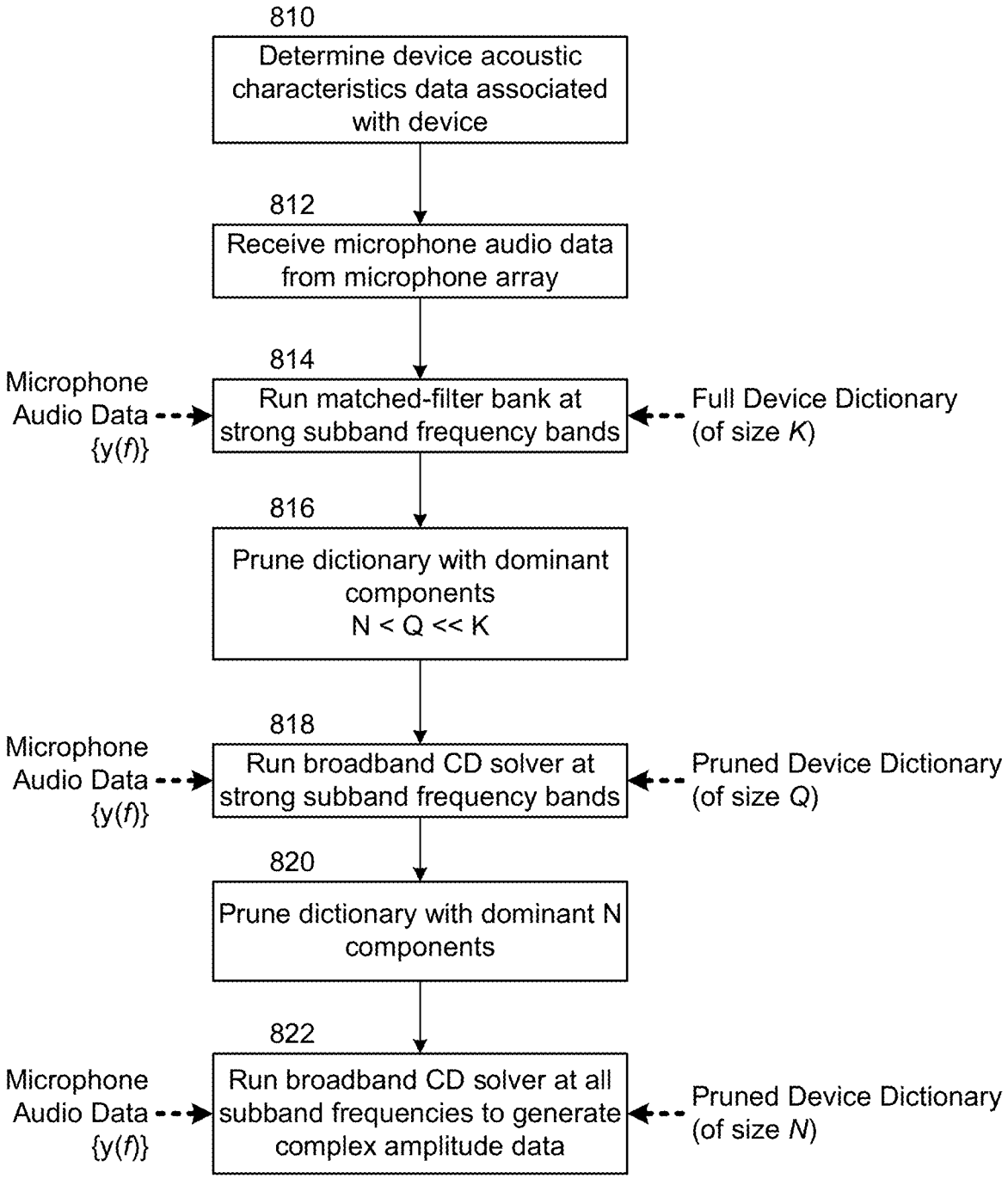
FIG. 8 is a flowchart conceptually illustrating an example method for performing acoustic wave decomposition to determine complex amplitude data according to embodiments of the present disclosure.

FIG. 7 is a flowchart conceptually illustrating an example method for performing acoustic wave decomposition to determine complex amplitude data according to embodiments of the present disclosure. As illustrated in FIG. 7, the device 110 may determine (710) device acoustic characteristics data 114 associated with the device 110 and may receive (712) microphone audio data 112 from the microphone array 120.

The first step computes a pruned set of indices A that contains the nonzero coefficients at all frequencies. This effectively reduces the problem size from |D| to $|\Lambda|$, which is a reduction of about two orders of magnitude. The pruned set $\Lambda$ is computed by a two-dimensional matched filter followed by a small scale LASSO optimization. In some examples, the device 110 may determine (714) energy values for each angle in the device acoustic characteristics data 114. For example, for each angle $(\phi_1, \theta_1)$ in the device dictionary, the device 110 may calculate:

$$\Gamma(\theta_l, \phi_l) = \int_{\omega} \sigma(\omega)\|\langle y(\omega), \eta(k(\omega, \theta_l, \phi_l))\rangle\|^2 \quad [11]$$

where the weighting σ(ω) is a function of the signal-to-noise-ratio (SNR) of the corresponding time-frequency cell. This metric is only calculated when the target signal is present.

The device 110 may identify (716) local maxima represented in the energy values. For example, the device 110 may identify local maxima of $\Gamma(\phi_1, \theta_1)$ and discard values in the neighborhood of the stronger maxima (e.g., values for angles within 10° of the local maxima). This pruning is needed to improve the numerical stability of the optimization problem.

The device 110 may determine (718) pruned set with indices of the strongest surviving local maxima. For example, the device 110 may find a superset $\bar{\Lambda}$ with the indices of the strongest surviving local maxima of $(\phi_1, \theta_1)$, with $|\bar{\Lambda}| \geq |\Lambda|$. In some examples, the device 110 may optionally perform (720) optimization with a coordinate-descent solver to refine the pruned set. For example, the device 110 may run LASSO optimization with coordinate-descent solver, but with entries limited to $\bar{\Lambda}$, and may choose the indices of the highest energy components in the output solution as $\Lambda$. This search procedure runs only on a subset of high energy frequency components, rather than the whole spectrum, and does not need to run at each time frame. The LASSO optimization in the last step yield a higher accuracy at a small complexity cost because a small number of iterations is sufficient to converge to $\wedge$.

The second step in the solution procedure solves the elastic net optimization problem in Equation [9] with the pruned set $\wedge$ to calculate the complex amplitude data 116 (e.g., $\{\alpha_1(\omega)_{l\in\wedge}\}$ for all $\omega$. Thus, the device 110 may solve (722) the optimization problem with the pruned set to determine the complex amplitude data 116. For example, the device 110 may use the optimization model 620 and the regularization function 630 described above with regard to FIG. 6 to determine the complex amplitude data 116. In some examples, the device 110 may use the coordinate-descent procedure, as it provides significant speedup as compared to gradient-descent, although the disclosure is not limited thereto. In addition, the regularization parameters (e.g., $\lambda_1$ and $\lambda_2$) may vary with frequency because the dictionary vectors are more correlated at lower frequencies.

FIG. 8 is a flowchart conceptually illustrating an example method for performing acoustic wave decomposition to determine complex amplitude data according to embodiments of the present disclosure. As illustrated in FIG. 8, the device 110 may determine (810) device acoustic characteristics data associated with the device 110 and may receive (812) microphone audio data from the microphone array 120.

Similar to the method illustrated in FIG. 7, the device 110 may solve the optimization problem in two stages; a search stage and a decomposition stage. During the search stage, the device 110 may determine the subset of indices (e.g., $\eta$) of the active acoustic waves. This has the effect of reducing the search space for the size of the dictionary $|D|$, which is in the order of a few hundred entries, to the number of active acoustic waves ($N\approx 20$). During the decomposition stage, the device 110 may calculate (e.g., $\{\alpha_1(\omega)_{l\in\wedge}\}$ to minimize the optimization model 620.

The search phase is solved using a combination of sparse recovery and correlation methods. The main issue is that the number of microphones (e.g., M) is smaller than the number of acoustic waves (e.g., N), making it an undetermined problem that requires design heuristics (e.g., through regularization). As illustrated in FIG. 8, the search phase is done in two steps. In the first step, the device 110 may run (814) a matched-filter bank at strong subband frequency bands (e.g., selected frequency components). The number of matched filters is the dictionary size K, and the highest energy subbands are selected for this stage. The device 110 may determine the highest energy subbands using Equation [11], described above. In the second step, the device 110 may prune (816) the dictionary with dominant components (e.g., $N<Q<<K$). For example, the device 110 may select the strongest Q components for further processing (e.g., only $Q<<K$ components of the device dictionary are further processed).

In the second stage, the device 110 may run a limited broadband coordinate-descent (CD) solver on a subset of the subbands with small number of iterations to further refine the components selection to the subset whose size equals the target number of output components N. For example, FIG. 8 illustrates that the device 110 may run (818) a broadband CD solver at strong subband frequency bands, with the pruned device dictionary of size Q. Thus, the device 110 uses the pruned dictionary Q to reduce processing complexity. The device 110 may further prune (820) the dictionary with dominant N components, such that the output is the selected indices set 11.

Using the pruned device dictionary (e.g., of size N), the device 110 may run (822) the broadband CD solver at all subband frequencies to generate the complex amplitude data 116. The regularization parameters in step 822 may be less strict than the regularization parameters of step 818 because of the smaller dictionary size. Further, the regularization parameters for each component may be weighted to be inversely proportional to its energy value calculated in step 814.

Figure 9:
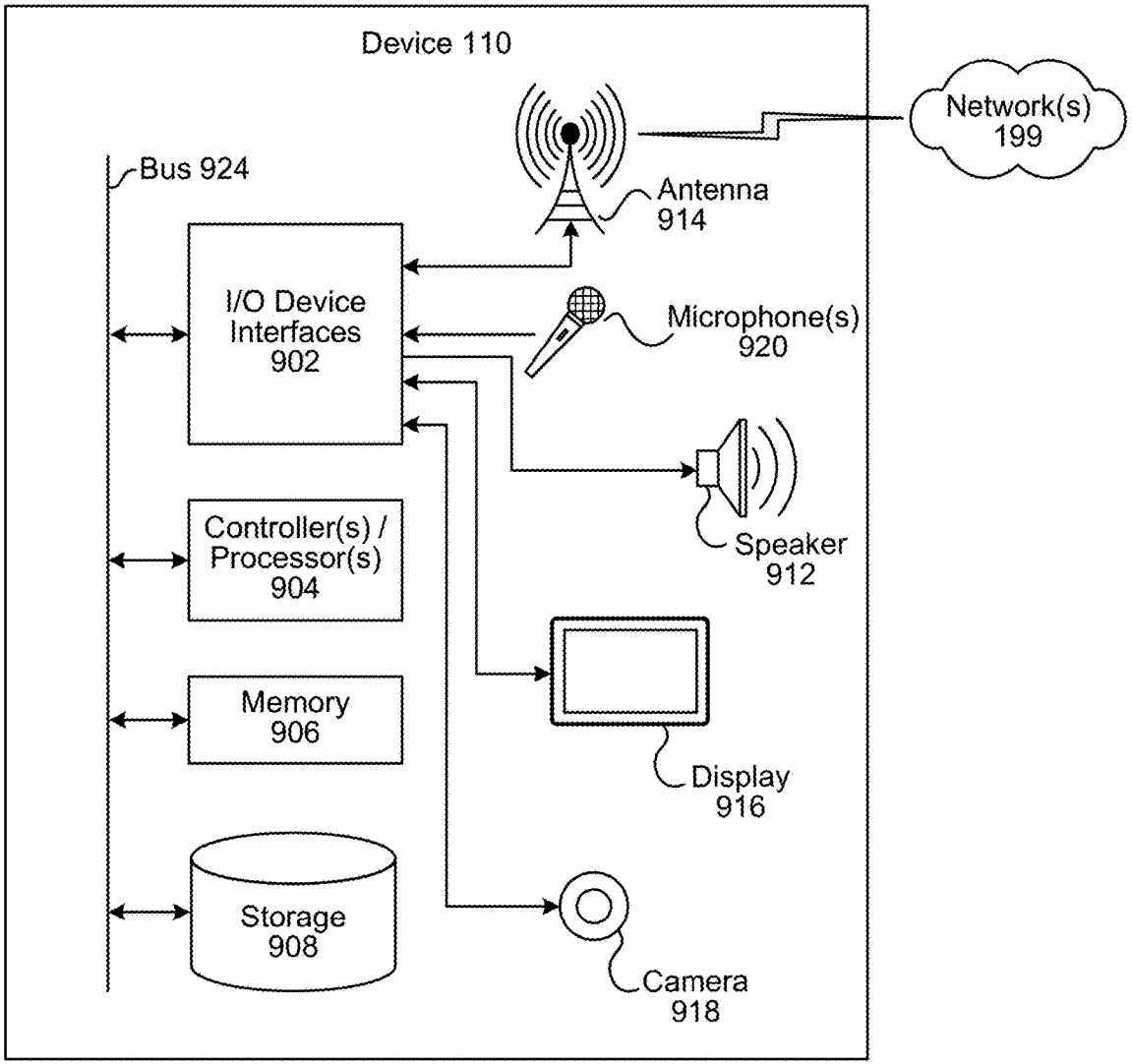
FIG. 9 is a block diagram conceptually illustrating example components of a device according to embodiments of the present disclosure.
Figure 10:
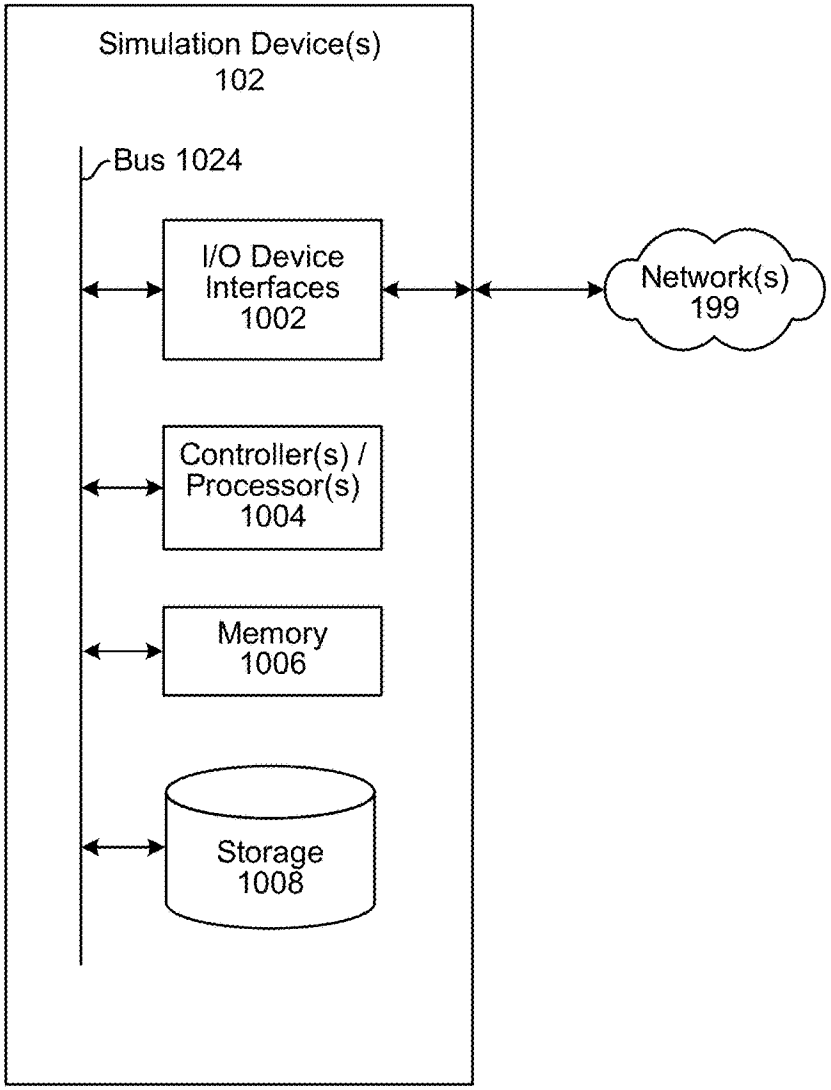
FIG. 10 is a block diagram conceptually illustrating example components of a simulation device according to embodiments of the present disclosure.

FIG. 9 is a block diagram conceptually illustrating a device 110 that may be used with the system according to embodiments of the present disclosure. FIG. 10 is a block diagram conceptually illustrating example components of a simulation device according to embodiments of the present disclosure. The simulation device 102 may include one or more servers. A "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The simulation device 102 may be configured to operate using one or more of a client-server model, a computer bureau model, grid computing techniques, fog computing techniques, mainframe techniques, utility computing techniques, a peer-to-peer model, sandbox techniques, or other computing techniques.

Each of these devices (110/102) may include one or more controllers/processors (904/1004), which may each include a central processing unit (CPU) for processing data and computer-readable instructions, and a memory (906/1006) for storing data and instructions of the respective device. The memories (906/1006) may individually include volatile random access memory (RAM), non-volatile read only memory (ROM), non-volatile magnetoresistive memory (MRAM), and/or other types of memory. Each device (110/102) may also include a data storage component (908/1008) for storing data and controller/processor-executable instructions. Each data storage component (908/1008) may individually include one or more non-volatile storage types such as magnetic storage, optical storage, solid-state storage, etc. Each device (110/102) may also be connected to removable or external non-volatile memory and/or storage (such as a removable memory card, memory key drive, networked storage, etc.) through respective input/output device interfaces (902/1002).

Computer instructions for operating each device (110/102) and its various components may be executed by the respective device's controller(s)/processor(s) (904/1004), using the memory (906/1006) as temporary "working" storage at runtime. A device's computer instructions may be stored in a non-transitory manner in non-volatile memory (906/1006), storage (908/1008), or an external device(s). Alternatively, some or all of the executable instructions may be embedded in hardware or firmware on the respective device in addition to or instead of software.

Each device (110/102) includes input/output device interfaces (902/1002). A variety of components may be connected through the input/output device interfaces (902/1002), as will be discussed further below. Additionally, each device (110/102) may include an address/data bus (924/1024) for conveying data among components of the respective device. Each component within a device (110/102) may also be directly connected to other components in addition to (or instead of) being connected to other components across the bus (924/1024).

Referring to FIG. 9, the device 110 may include input/output device interfaces 902 that connect to a variety of components such as an audio output component such as a speaker 912, a wired headset or a wireless headset (not illustrated), or other component capable of outputting audio. The device 110 may also include an audio capture component. The audio capture component may be, for example, microphone(s) 920 (e.g., array of microphones). If an array of microphones is included, approximate distance to a sound's point of origin may be determined by acoustic localization based on time and amplitude differences between sounds captured by different microphones of the array. In some examples, the device 110 may additionally include a display 915 for displaying content and/or a camera 918, although the disclosure is not limited thereto.

Via antenna(s) 914, the input/output device interfaces 902 may connect to one or more networks 199 via a wireless local area network (WLAN) (such as WiFi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface (902/1002) may also include communication components that allow data to be exchanged between devices such as different physical servers in a collection of servers or other components.

The components of the device (110/102) may include their own dedicated processors, memory, and/or storage. Alternatively, one or more of the components of the device (110/102) may utilize the I/O interfaces (902/1002), processor(s) (904/1004), memory (906/1006), and/or storage (908/1008) of the device (110/102), respectively.

As noted above, multiple devices may be employed in a single system. In such a multi-device system, each of the devices may include different components for performing different aspects of the system's processing. The multiple devices may include overlapping components. The components of the device (110/102), as described herein, are illustrative, and may be located as a stand-alone device or may be included, in whole or in part, as a component of a larger device or system.

Multiple device (110/102) and/or other components may be connected over a network(s) 199. The network(s) 199 may include a local or private network or may include a wide network such as the Internet. Devices may be connected to the network(s) 199 through either wired or wireless connections. For example, the devices 110 may be connected to the network(s) 199 through a wireless service provider, over a WiFi or cellular network connection, or the like. Other devices are included as network-connected support devices, such as the simulation device 102 and/or other components. The support devices may connect to the network(s) 199 through a wired connection or wireless connection.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of system may be implemented as in firmware or hardware, such as an acoustic front end (AFE), which comprises, among other things, analog and/or digital filters (e.g., filters configured as firmware to a digital signal processor (DSP)).

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present. As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

retrieving device acoustic characteristics data representing a frequency response of a microphone array of a device, the microphone array including a first microphone and a second microphone;

receiving first audio data corresponding to the first microphone and the second microphone;

determining, using the device acoustic characteristics data and the first audio data, first data including a first value corresponding to a first acoustic plane wave of a plurality of acoustic plane waves;

determining that the first value exceeds a threshold value;

selecting, using the threshold value, a portion of the first data that includes the first value, the portion of the first data corresponding to a subset of the plurality of acoustic plane waves;

determining a subset of the device acoustic characteristics data corresponding to the subset of the plurality of acoustic plane waves;

generating a first optimization model, using the subset of the device acoustic characteristics data and the first audio data;

determining first coefficient data corresponding to the plurality of acoustic plane waves by solving the first optimization model; and generating second audio data using the device acoustic characteristics data, the first coefficient data, and the plurality of acoustic plane waves, the second audio data representing acoustic pressure values corresponding to the plurality of acoustic plane waves and scattering corresponding to a surface of the device.

2. The computer-implemented method of claim 1, wherein determining the first data further comprises:

determining, using the first audio data and a first portion of the device acoustic characteristics data that corresponds to the first acoustic plane wave, the first value; and determining, using the first audio data and a second portion of the device acoustic characteristics data that corresponds to a second acoustic plane wave of the plurality of acoustic plane waves, a second value, and the method further comprising:

determining, using the first value and the second value, the threshold value;

determining that the second value is less than the threshold value;

selecting the portion of the first data, the portion of the first data including the first value but not the second value; and determining, using the portion of the first data, the subset of the plurality of acoustic plane waves.

3. The computer-implemented method of claim 1, wherein determining the subset of the device acoustic characteristics data further comprises:

determining, using the portion of the first data, second data representing first acoustic plane waves and second acoustic plane waves of the plurality of acoustic plane waves;

generating a second optimization model using a portion of the device acoustic characteristics data that is associated with the first acoustic plane waves and the second acoustic plane waves;

solving the second optimization model using a coordinate descent technique to generate third data representing the first acoustic plane waves, wherein the first acoustic plane waves correspond to the subset of the plurality of acoustic plane waves; and determining the subset of the device acoustic characteristics data that is associated with the first acoustic plane waves.

4. The computer-implemented method of claim 1, wherein determining the first data further comprises:

determining a second value of a first portion of the first audio data, the first portion of the first audio data corresponding to a first frequency range;

determining, using the device acoustic characteristics data, a third value associated with the first frequency range, the third value corresponding to the first acoustic plane wave;

determining a first energy value using the second value and the third value;

determining a fourth value of a second portion of the first audio data, the second portion of the first audio data corresponding to a second frequency range;

determining, using the device acoustic characteristics data, a fifth value associated with the second frequency range, the fifth value corresponding to the first acoustic plane wave;

determining a second energy value using the fourth value and the fifth value; and determining the first value by adding the first energy value and the second energy value.

5. A computer-implemented method, the method comprising:

receiving first audio data;

determining first data, the first data corresponding to a first microphone and a second microphone of a device;

determining, using the first audio data and the first data, second data corresponding to first acoustic waves from a plurality of acoustic waves;

determining, using the second data, a subset of the first data that corresponds to the first acoustic waves;

generating a first optimization model, using the subset of the first data and the first audio data;

determining first coefficient data corresponding to the plurality of acoustic waves by solving the first optimization model; and generating second audio data using the first data, the first coefficient data, and information about the plurality of acoustic waves.

6. The computer-implemented method of claim 5, wherein determining the second data further comprises:

determining a first value of a first portion of the first audio data, the first portion of the first audio data corresponding to a first frequency range;

determining, using the first data, a second value associated with the first frequency range, the second value corresponding to a first acoustic wave of the plurality of acoustic waves;

determining a first energy value using the first value and the second value;

determining a third value of a second portion of the first audio data, the second portion of the first audio data corresponding to a second frequency range;

determining, using the first data, a fourth value associated with the second frequency range, the fourth value corresponding to the first acoustic wave;

determining a second energy value using the third value and the fourth value; and determining a third energy value by adding the first energy value and the second energy value, wherein the third energy value corresponds to the first acoustic wave.

7. The computer-implemented method of claim 5, wherein determining the second data further comprises:

determining, using the first audio data and the first data, a first energy value associated with a first acoustic wave of the plurality of acoustic waves;

determining, using the first audio data and the first data, a second energy value associated with a second acoustic wave of the plurality of acoustic waves;

determining that the first energy value exceeds the second energy value; and determining the second data, wherein the second data corresponds to the first acoustic wave but not the second acoustic wave.

8. The computer-implemented method of claim 5, wherein determining the subset of the first data further comprises:

determining a portion of the second data corresponding to highest energy values represented in the second data;

determining the first acoustic waves that correspond to the portion of the second data; and determining the subset of the first data that is associated with the first acoustic waves.

9. The computer-implemented method of claim 5, wherein determining the first coefficient data further comprises:

determining regularization data associated with the first optimization model, the regularization data corresponding to elastic net regularization; and determining the first coefficient data by solving the first optimization model using the regularization data.

10. The computer-implemented method of claim 5, wherein determining the subset of the first data further comprises:

determining, using the second data, third data representing the first acoustic waves and second acoustic waves from the plurality of acoustic waves;

generating a second optimization model associated with the first acoustic waves and the second acoustic waves;

solving the second optimization model using a coordinate descent technique to generate fourth data representing the first acoustic waves; and determining the subset of the first data that is associated with the first acoustic waves.

11. The computer-implemented method of claim 10, wherein the first optimization model is associated with the first acoustic waves, and determining the first coefficient data further comprises:

solving the first optimization model using the coordinate descent technique to determine the first coefficient data.

12. The computer-implemented method of claim 5, wherein the first data includes at least one vector representing a plurality of values, a first number of the plurality of values corresponding to a second number of microphones in a microphone array, a first value of the plurality of values corresponding to the first microphone and representing an acoustic pressure at the first microphone in response to an acoustic wave.

13. A system comprising:

at least one processor; and memory including instructions operable to be executed by the at least one processor to cause the system to:

receive first audio data;

determine first data, the first data corresponding to a first microphone and a second microphone of a device;

determine, using the first audio data and the first data, second data corresponding to first acoustic waves from a plurality of acoustic waves;

generate a first optimization model, using the second data;

determine a subset of the first data that corresponds to the first acoustic waves by solving the first optimization model;

determine, using the subset of the first data and the first audio data, first coefficient data corresponding to the plurality of acoustic waves; and generate third data using the first data, the first coefficient data, and information about the plurality of acoustic waves.

14. The system of claim 13, wherein the memory further comprises instructions that, when executed by the at least one processor, further cause the system to:

determine a first value of a first portion of the first audio data, the first portion of the first audio data corresponding to a first frequency range;

determine, using the first data, a second value associated with the first frequency range, the second value corresponding to a first acoustic wave of the plurality of acoustic waves;

determine a first energy value using the first value and the second value;

determine a third value of a second portion of the first audio data, the second portion of the first audio data corresponding to a second frequency range;

determine, using the first data, a fourth value associated with the second frequency range, the fourth value corresponding to the first acoustic wave;

determine a second energy value using the third value and the fourth value; and determine a third energy value by adding the first energy value and the second energy value, wherein the third energy value corresponds to the first acoustic wave.

15. The system of claim 13, wherein the memory further comprises instructions that, when executed by the at least one processor, further cause the system to:

determine, using the first audio data and the first data, a first energy value associated with a first acoustic wave of the plurality of acoustic waves;

determine, using the first audio data and the first data, a second energy value associated with a second acoustic wave of the plurality of acoustic waves;

determine that the first energy value exceeds the second energy value; and determine the second data, wherein the second data corresponds to the first acoustic wave but not the second acoustic wave.

16. The system of claim 13, wherein the memory further comprises instructions that, when executed by the at least one processor, further cause the system to:

determine a portion of the second data corresponding to highest energy values represented in the second data, wherein the first optimization model is generated using the portion of the second data.

17. The system of claim 13, wherein the memory further comprises instructions that, when executed by the at least one processor, further cause the system to:

generate a second optimization model using the subset of the first data and the first audio data;

determine regularization data associated with the second optimization model, the regularization data corresponding to elastic net regularization; and determine the first coefficient data by solving the second optimization model using the regularization data.

18. The system of claim 13, wherein the memory further comprises instructions that, when executed by the at least one processor, further cause the system to:

determine, using the second data, third data representing the first acoustic waves and second acoustic waves from the plurality of acoustic waves;

generate the first optimization model associated with the first acoustic waves and the second acoustic waves;

solve the first optimization model using a coordinate descent technique to generate fourth data representing the first acoustic waves; and determine the subset of the first data that is associated with the first acoustic waves.

19. The system of claim 18, wherein the memory further comprises instructions that, when executed by the at least one processor, further cause the system to:

generate, using the subset of the first data and the first audio data, a second optimization model associated with the first acoustic waves; and solve the second optimization model using the coordinate descent technique to determine the first coefficient data.

20. The system of claim 13, wherein the first data includes at least one vector representing a plurality of values, a first number of the plurality of values corresponding to a second number of microphones in a microphone array, a first value of the plurality of values corresponding to the first microphone and representing an acoustic pressure at the first microphone in response to an acoustic wave.

* * * * *